United States Patent [19]

DeYarman

[11] Patent Number: 4,787,374

[45] Date of Patent: Nov. 29, 1988

[54] LIQUID APPLICATOR DEVICE HAVING CAVITIES TO RETAIN DROP OF LIQUID

[76] Inventor: James B. DeYarman, 990 Highland Rd., #310, Solana Beach, Calif. 92075

[21] Appl. No.: 175,599

[22] Filed: Mar. 23, 1988

Related U.S. Application Data

[63] Continuation of Ser. No. 867,757, May 29, 1986, abandoned.

[51] Int. Cl.[4] ..... A61H 7/00

[52] U.S. Cl. ..... 128/65; 128/67

[58] Field of Search ..... 128/65, 67, 60, 61, 128/62 R

[56] References Cited

U.S. PATENT DOCUMENTS

| | | | |
|---|---|---|---|
| D. 269,376 | 6/1983 | Nakao et al. . | |
| 1,012,653 | 12/1911 | Knickerbocker | 128/65 |
| 1,491,016 | 4/1924 | McGowan et al. | 15/188 |
| 1,554,510 | 9/1925 | Kirby | 15/198 |
| 1,611,542 | 12/1926 | Mair | 128/60 |
| 1,618,059 | 2/1927 | Cocroft | 128/65 |
| 1,705,249 | 3/1929 | Henry | 128/62 R |
| 1,819,628 | 8/1931 | Van Sant | 128/65 |
| 1,925,019 | 8/1933 | Wilson | 15/188 |
| 2,379,330 | 6/1945 | Wilensky | 128/65 |
| 3,151,346 | 10/1964 | Gray | 15/187 |
| 3,545,434 | 12/1970 | Woodruff . | |
| 4,463,485 | 8/1984 | Gueret . | |

*Primary Examiner*—Edgar S. Burr
*Assistant Examiner*—Tonya Lamb
*Attorney, Agent, or Firm*—Jerry R. Seiler

[57] ABSTRACT

An improved applicator for applying a liquid composition comprises a flexible base member having a plurality of integral alternating first and second protuberances the first protuberances having a concave cup of dimensions for holding and retaining a drop of liquid when the applicator is held upside down and second protuberances having a convex-shaped surface, the protuberances being of substantially the same diameter and projecting substantially the same distance from a planar surface.

7 Claims, 2 Drawing Sheets

LIQUID APPLICATOR DEVICE HAVING CAVITIES TO RETAIN DROP OF LIQUID

This is a continuation of co-pending application Ser. No. 06/867,757, filed on May 29, 1986, now abandoned.

BACKGROUND OF THE INVENTION

The application and spreading of liquid materials the liquid to be applied is to be used only in a small amount, such as a few drops in each application, a special applicator is required for assuring the reasonably uniform spreading of the small amount of liquid over the desired scalp area as well as to insure its penetration into the skin. Attempts to apply and spread such small amounts of material using one's fingers is usually unsatisfactory, especially where the composition comprises an aqueous base because of body oils which create an aquaphobic surface. Moreover, it is undesirable to attempt to use one's fingers for such applications because of bacteria present in the fingernails, as well as partial penetration of the liquid material itself on the fingers and hands during the application.

Prior applicators for attempting to apply liquid compositions such as described in U.S. Pat. Nos. 1,819,628 and 1,618,059 are generally not satisfactory because of the lack of control of applying, and evenly spreading very small amounts, such as a few drops, of a liquid composition during the application. These prior devices include reservoirs for supplying liquid through the applicator including ducts and protuberances, but do not provide for controlled and suitable economic distribution of very small amounts of liquid.

SUMMARY OF THE INVENTION

The applicator device of the present invention provides a useful means for applying very small amounts of liquid compositions, particularly those in which only a relatively few drops of such liquid are to be applied at a given time. The applicator includes means for depositing the individual drops of liquid in individual cups in the applicator as well as additional means for assisting in spreading and improving penetration of the liquid on the skin of the user.

DETAILED DESCRIPTION OF THE INVENTION

Figure 1:
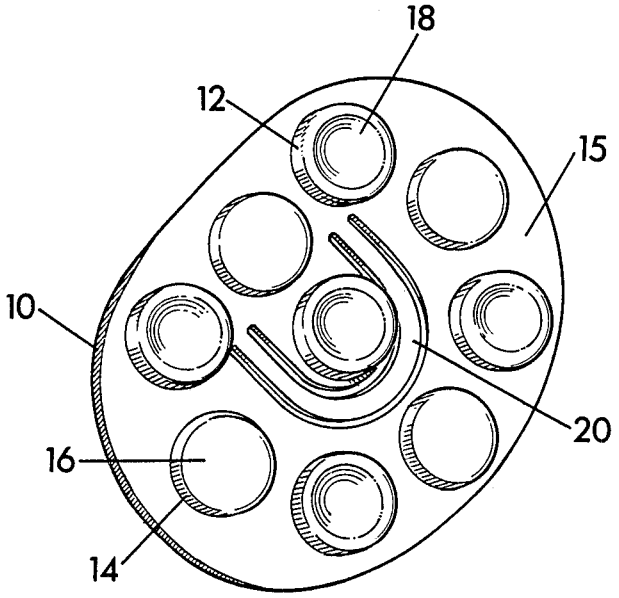
FIG. 1 is a front, top perspective view of the applicator of the invention.

In the drawings there is shown the applicator of the invention. In the preferred embodiment illustrated, the applicator comprises a base member 10 having an upper or top surface 15 from which two different types of protuberances extend. In the preferred device, the applicator comprises a single molded product formed with the protuberances extending from and being integrally formed with base member 10. The applicator is preferably molded of a flexible thermoplastic material such as an SBR rubber or similar thermoplastic elastomers such as block copolymers of polystyrene and elastomeric polybutadiene or polyisoprene. Examples of such materials include Kraton®, a registered trademark of Shell Chemical Co., Solprene®, a registered trademark of Phillips Petroleum Co., as well as Hytrel® polyester elastomers, a DuPont Co. registered trademark and TPR® thermoplastic rubbers, a Uniroyal, Inc. registered trademark. Other similar synthetic elastomers as well as natural rubber may be used and will be appreciated by those skilled in the art.

Figure 2:
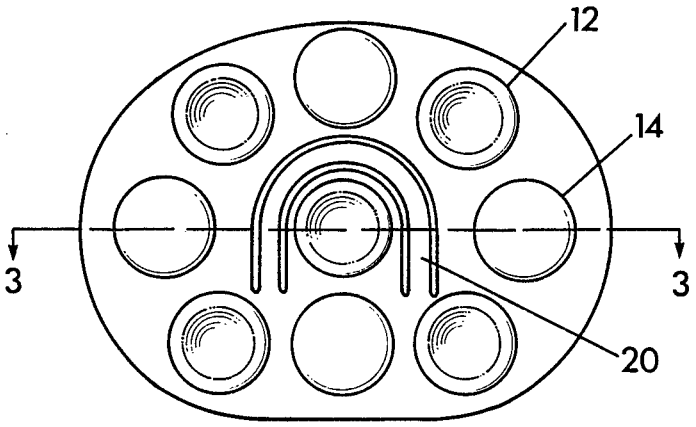
FIG. 2 is a top plan view of the applicator.
Figure 3:
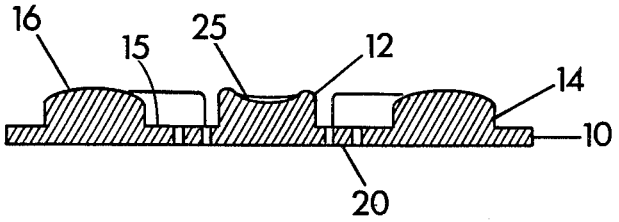
FIG. 3 is a sectional elevation taken along lines 3—3 of FIG. 2.

In FIGS. 1–3 there are shown first and second protuberances, 12 and 14, respectively, extending from flat upper surface 15 of base member 10. These protuberances are preferably substantially equal in length and circular in cross-section. Each first protuberance 12 is provided with a cup 18 which comprises a uniform concave depression formed in the exposed end of the protuberance. The cups are uniform in shape and circular in cross-section and have a depth and diameter sufficient to hold and retain one drop of liquid 25 in the cup as shown in FIG. 3. For example, in the preferred embodiment shown, the maximum depth of the cup is between about 1 and 2 mm with a diameter at the upper edge of the cup being between about 10 and about 15 mm. Because of this cup size and shape, when a drop is placed in the cup, it will be retained even when the applicator is turned upside down due to the surface tension of the liquid in the cup surface. Also, such preferred cup dimensions allows the skin to project into the cup during application and assist in removing liquid in the cup.

The protuberances are integrally formed on the base member and thus are solid throughout their cross-section as illustrated. This will also give firmness to the protuberances desirable in the rubbing action during application of the liquid material. It is also important that the cup or cavity in the first protuberances does not form a suction on the skin which would restrict movement of the applicator when liquid is being applied and spread. Accordingly, the avoidance of any suction action of the cups is provided by the preferred dimensions described above including the relatively shallow cup dimensions. It is also preferred that the shoulder of the cup be rounded as shown thereby avoiding any relatively thin cup edge or periphery which might otherwise cause such a suction as it is applied or contacted with the skin.

Second protuberance 14 is provided with a convex end surface 16 for assisting in spreading and improving penetration of the liquid on the skin of the user. The first and second protuberances are preferably substantially the same length. A suitable length of 5–8 mm is preferred. The cross-sectional diameter of the protuberance is not especially critical but in the embodiment shown is about 16 mm whereby the appropriate number of first and second protuberances may be efficiently spaced on the flat base member surface.

The number of protuberances is not critical except that in the preferred embodiment shown, with the diameter of the first protuberances being determined somewhat by the diameter of cup 18, i.e., greater than about 10 mm, between about 7 and about 12 protuberances uniformly spaced on the base member will normally be sufficient. A suitable applicator would contain between about 4 and about 7 of first protuberances provided with liquid holding and retaining cups and an equal number of second protuberances plus or minus 1.

Figure 4:
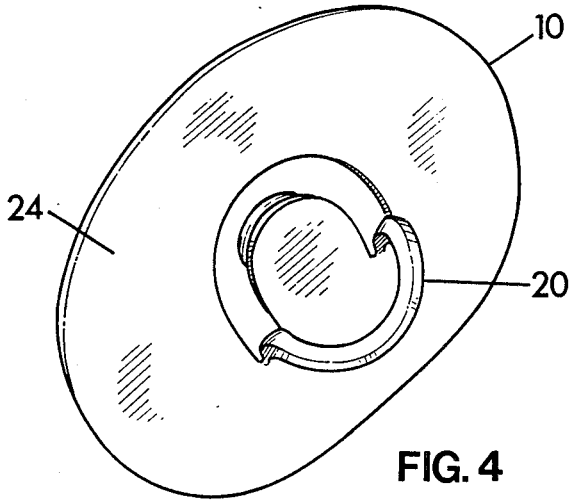
FIG. 4 is a bottom perspective view of the applicator.
Figure 5:
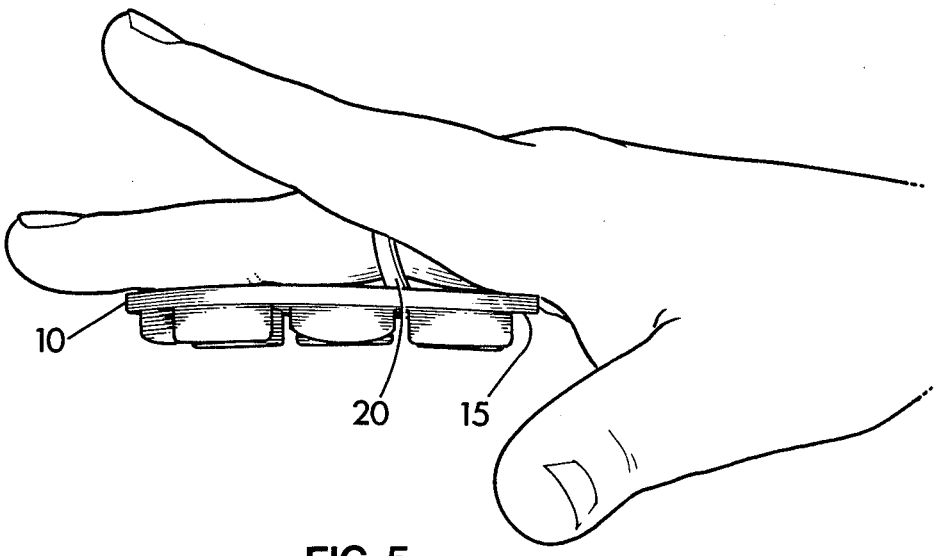
FIG. 5 is a side view illustrating the applicator secured on a user's hand.

The shape and size of the applicator is also such that it can be comfortably held in the hand of the user, preferably across the bottom of the fingers above the palm as shown in FIG. 5. The maximum length of the applicator base may extend across the fingers of the user and somewhat therebeyond. The applicator is also preferably provided with means for being secured on the hand of the user. A convenient means is provided in the preferred embodiment illustrated comprising a flexible finger-hold ring strap 20 integrally formed in the flexible base member. The strap may be extended out from surface 24 as illustrated in FIG. 4 so that the user's middle or index finger can be conveniently placed through the loop when the device is being used as seen in FIG. 5. The applicator may be used to apply a multitude of desirable liquid compositions to a user's skin including medicines, skin creams, lotions, etc. However, it is particularly useful in applying hair and scalp treatment compositions which are much more difficult to apply and spread and penetrate evenly using present devices. These and other features of the applicator will be evident from the drawings as further expressed in the claims within the purview of the invention.

I claim:

1. An applicator for applying, spreading and penetrating a liquid composition into the skin comprising a flexible base member for being held in a user's hand having a planar top surface, and a plurality of first and second protuberances of substantially equal length integral with and extending from said top surface, said first protuberances having a non-suction forming cavity of circular cross-section having a depth of between about 1 and 2 mm and a diameter of between about 10 and 15 mm whereby said cavity is capable of holding and retaining a drop of said liquid composition when said applicator is held with said cup upside down, said combined depth and diameter dimensions of said cavity providing means for allowing skin of a user to project into said cavity to remove substantially all of said liquid composition therefrom, said second protuberances having a convex surface of circular cross-section, said first and second protuberances being alternately arranged on said top surface whereby at least one second protuberance is immediately adjacent each of said first protuberances.

2. The applicator of claim 1 wherein said first and second protuberances are of substantially equal diameter.

3. The applicator of claim 2 wherein said top surface is oblong in shape and has a majority of said protuberances located adjacent the periphery of said top surface.

4. The applicator of claim 1 wherein said base member includes means for being secured on a user's finger.

5. The applicator of claim 4 wherein said applicator comprises a thermoplastic elastomer.

6. In combination, the applicator of claim 1 and a drop of liquid skin treating composition received in at least one of said cups.

7. A method of applying a liquid composition to a user's skin comprising placing a drop of said liquid in at least one cup of an applicator said applicator comprising a flexible base member for being held in a user's hand having a planar top surface, and a plurality of first and second protuberances of substantially equal length integral with and extending from said top surface, said first protuberances having a non-suction forming cavity of circular cross-section having a depth of between about 1 and 2 mm and a diameter of between about 10 and 15 mm whereby said cavity is capable of holding and retaining a drop of said liquid composition when said applicator is held with said cup upside down, said second protuberances having a convex surface of circular cross-section and wherein said combined depth and diameter dimensions of said cavity allow the skin of a user to project into said cavity to remove substantially all of said liquid composition therefrom when said applicator containing said liquid is passed along the user's skin during use thereof, said first and second protuberances being alternately arranged on said to surface whereby at least one second protuberance is immediately adjacent each of said first protuberances, turning said applicator upside down, and contacting the skin with said first and second protuberances to apply and spread said drop of said liquid thereon.

* * * * *